US011478842B1

(12) United States Patent
Izutsu et al.

(10) Patent No.: US 11,478,842 B1
(45) Date of Patent: Oct. 25, 2022

(54) FASTENING TOOL

(71) Applicant: MAKITA CORPORATION, Anjo (JP)

(72) Inventors: Yuta Izutsu, Anjo (JP); Kisho Sekido, Anjo (JP)

(73) Assignee: MAKITA CORPORATION, Anjo (JP)

( * ) Notice: Subject to any disclaimer, the term of this patent is extended or adjusted under 35 U.S.C. 154(b) by 0 days.

(21) Appl. No.: 17/719,481

(22) Filed: Apr. 13, 2022

(30) Foreign Application Priority Data

May 10, 2021 (JP) ..... JP2021-079830

(51) Int. Cl.

| | |
|---|---|
| ***B21J 15/26*** | (2006.01) |
| ***B21J 15/04*** | (2006.01) |
| ***B21J 15/28*** | (2006.01) |
| ***B21J 15/34*** | (2006.01) |
| ***B21J 15/10*** | (2006.01) |

(52) U.S. Cl.
CPC ..... *B21J 15/26* (2013.01); *B21J 15/043* (2013.01); *B21J 15/105* (2013.01); *B21J 15/28* (2013.01); *B21J 15/34* (2013.01)

(58) Field of Classification Search
CPC . B21J 15/26; B21J 15/043; B21J 15/28; B21J 15/105; B21J 15/34
See application file for complete search history.

(56) References Cited

U.S. PATENT DOCUMENTS

| | | | | |
|---|---|---|---|---|
| 5,473,805 | A * | 12/1995 | Wille | B21J 15/26 29/243.526 |
| 5,655,289 | A * | 8/1997 | Wille | B21J 15/28 29/703 |
| 6,145,360 | A * | 11/2000 | Honsel | B21J 15/28 72/449 |
| 11,065,674 | B2 * | 7/2021 | Kawai | B21J 15/105 |
| 2010/0139067 | A1 * | 6/2010 | Chen | B21J 15/043 29/243.521 |
| 2019/0283111 | A1 * | 9/2019 | Kawai | B21J 15/28 |
| 2020/0139424 | A1 * | 5/2020 | Yabuguchi | B21J 15/26 |

FOREIGN PATENT DOCUMENTS

| | | | | |
|---|---|---|---|---|
| JP | 2019-000892 | A | 1/2019 | |
| JP | 2019000892 | A * | 1/2019 | B21J 15/043 |

* cited by examiner

*Primary Examiner* — Bayan Salone
(74) *Attorney, Agent, or Firm* — Oliff PLC

(57) ABSTRACT

A fastening tool includes a motor, an anvil, a pin-gripping part, a magnet having the north pole and the south pole aligned in a front-rear direction and configured to move integrally with the pin-gripping part in the front-rear direction, a first magnetic sensor having a first sensing surface, a second magnetic sensor having a second sensing surface and disposed rearward of the first magnetic sensor, and a control device configured to move the pin-gripping part rearward based on a detection result of the second magnetic sensor and to move the pin-gripping part forward based on a detection result of the first magnetic sensor. The first and second magnetic sensors are unipolar detection type sensors configured to detect a same specified pole of the magnet. Orientations of the first sensing surface and the second sensing surface relative to a movement axis of the magnet are opposite to each other.

16 Claims, 12 Drawing Sheets

FASTENING TOOL

CROSS-REFERENCE TO RELATED APPLICATION

The present application claims priority to Japanese patent application No. 2021-079830 filed on May 10, 2021, the contents of which are hereby fully incorporated herein by reference.

TECHNICAL FIELD

The present disclosure relates to a fastening tool that is configured to fasten workpieces via a fastener.

BACKGROUND

Known fastening tools are configured to fasten workpieces via a fastener including a pin and a tubular part. For example, Japanese Unexamined Patent Application Publication No. 2019-000892 discloses a fastening tool having a pin-gripping part (a jaw assembly) that is configured to pull the pin in its axial direction relative to the tubular part in a process in which the pin-gripping part moves rearward from an initial position, so as to deform the fastener and fasten workpieces via the fastener. The pin-gripping part is returned to the initial position after the pin-gripping part reaches a stop position. The movement of the pin-gripping part is controlled based on detection results of two sensors.

SUMMARY

In the above-described fastening tool, each of the two sensors is a Hall effect sensor that detects a magnetic field of a magnet, which moves integrally with the pin-gripping part. A detection accuracy of a position detection mechanism that utilizes a magnetic sensor, e.g., a Hall effect sensor is affected by a mounting condition of the magnetic sensor.

Accordingly, it is an object of the present disclosure to provide improvement in a position detection mechanism of a fastening tool that fastens workpieces via a fastener including a pin and a tubular part.

One aspect of the present disclosure provides a fastening tool that is configured to fasten workpieces via a fastener that includes a pin and a tubular part. The fastening tool includes a motor, an anvil, a pin-gripping part, a magnet, a first magnetic sensor, a second magnetic sensor and a control device.

The anvil is configured to abut the tubular part. The pin-gripping part is configured to grip the pin of the fastener. The pin-griping part is configured to be moved relative to the anvil along a first axis, using power of the motor. The first axis defines a front-rear direction of the fastening tool. The magnet has the north pole and the south pole that are aligned in the front-rear direction. The magnet is configured to move integrally with the pin-gripping part in the front-rear direction along a second axis that is parallel to the first axis. The first magnetic sensor has a first sensing surface. The second magnetic sensor has a second sensing surface. The second magnetic sensor is disposed rearward of the first magnetic sensor in the front-rear direction. The control device is configured to move the pin-gripping part rearward relative to the anvil from an initial position to a stop position based on a detection result of the second magnetic sensor. The control device is also configured to move the pin-gripping part forward relative to the anvil from the stop position to the initial position based on a detection result of the first magnetic sensor.

The first magnetic sensor and the second magnetic sensor are unipolar detection type sensors that are configured to detect (respond to) a same specified pole of the magnet. In other words, both of the first magnetic sensor and the second magnetic sensor are configured to respond to only the north pole of the magnet (i.e., to detect only the magnet field of the north pole) or to respond to only the south pole of the magnet (i.e., to detect only the magnet field of the south pole). The first magnetic sensor and the second magnetic sensor are arranged such that an orientation of the first sensing surface relative to the second axis is opposite to an orientation of the second sensing surface relative to the second axis.

In the fastening tool of this aspect, the pole of the magnet that first comes closer to the second magnetic sensor from the front is different from the pole of the magnet that first comes closer to the first magnetic sensor from the rear. Further, the orientation of the first sensing surface of the first magnetic sensor relative to the second axis (i.e., a movement axis of the magnet) is opposite to the orientation of the second sensing surface of the second magnetic sensor relative to the second axis. Accordingly, one of the first magnetic sensor and the second magnetic sensor can function similarly to a unipolar detection type sensor that detects the other pole that is different from the originally-designated pole to be detected by that magnetic sensor. Thus, a change of the magnetic field (the magnetic flux density) of the pole to be detected by the second magnetic sensor when the magnet comes closer to the second magnetic sensor from the front can be made similar to a change of the magnetic field (magnetic flux density) of the pole to be detected by the first magnetic sensor when the magnet comes closer to the first magnetic sensor from the rear. This configuration facilitates design of dimensions of the fastening tool and thus reduces a possibility that a dimensional error occurs. As a result, the position of the pin-gripping part can be detected with improved accuracy.

Another aspect of the present disclosure provides a fastening tool that is configured to fasten workpieces via a fastener that includes a pin and a tubular part. The fastening tool includes a motor, an anvil, a pin-gripping part, a magnet, a first magnetic sensor, a second magnetic sensor and a control device.

The anvil is configured to abut the tubular part. The pin-gripping part is configured to grip the pin of the fastener. The pin-griping part is configured to be moved relative to the anvil along a first axis, using power of the motor. The first axis defines a front-rear direction of the fastening tool. The magnet has the north pole and the south pole that are aligned in the front-rear direction. The magnet is configured to move integrally with the pin-gripping part in the front-rear direction along a second axis that is parallel to the first axis. The first magnetic sensor has a first sensing direction that is defined for the first magnetic sensor. The second magnetic sensor has a second sensing direction that is defined for the second magnetic sensor. The second magnetic sensor is disposed rearward of the first magnetic sensor. The control device is configured to move the pin-gripping part rearward relative to the anvil from an initial position to a stop position based on a detection result of the second magnetic sensor. The control device is also configured to move the pin-gripping part forward relative to the anvil from the stop position to the initial position based on a detection result of the first magnetic sensor.

The first magnetic sensor and the second magnetic sensor are unipolar detection type sensors that are configured to detect (respond to) a same specified pole of the magnet. In other words, both of the first magnetic sensor and the second magnetic sensor are configured to respond to only the north pole of the magnet (i.e., to detect only the magnet field of the north pole) or to respond to only the south pole of the magnet (i.e., to detect only the magnet field of the south pole). The first magnetic sensor and the second magnetic sensor are arranged such that an orientation of the first sensing direction relative to the second axis is opposite to an orientation of the second sensing direction relative to the second axis.

In the fastening tool of this aspect, the pole of the magnet that first comes closer to the second magnetic sensor from the front is different from the pole of the magnet that first comes closer to the first magnetic sensor from the rear. Further, the orientation of the first sensing direction of the first magnetic sensor relative to the second axis (i.e., a movement axis of the magnet) is opposite to the orientation of the second sensing direction of the second magnetic sensor relative to the second axis. Accordingly, one of the first magnetic sensor and the second magnetic sensor can function similarly to a unipolar detection type sensor that detects the other pole that is different from the originally-designated pole to be detected by that magnetic sensor. Thus, a change of the magnetic field (the magnetic flux density) of the pole to be detected by the second magnetic sensor when the magnet comes closer to the second magnetic sensor from the front can be made similar to a change of the magnetic field of the pole to be detected by the first magnetic sensor when the magnet comes closer to the first magnetic sensor from the rear. This configuration facilitates design of dimensions of the fastening tool and thus reduces a possibility that a dimensional error occurs. As a result, the position of the pin-gripping part can be detected with improved accuracy.

DETAILED DESCRIPTION OF THE EMBODIMENTS

Figure 1:
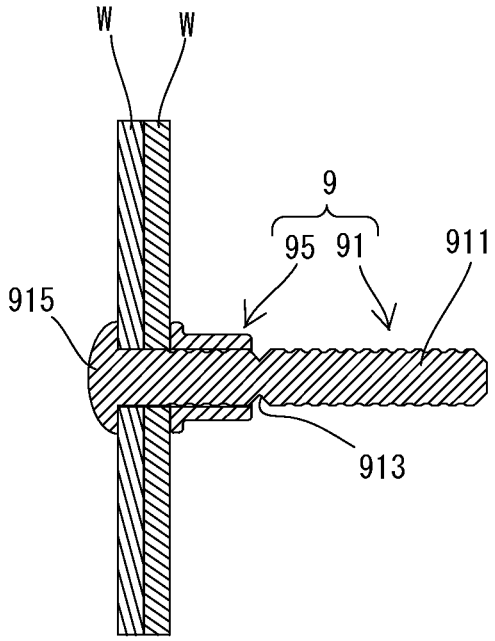
FIG. 1 is a cross-sectional view of an example of a fastener to be used by a fastening tool.

In one or more non-limiting embodiments, the specified pole may be a first one of the north pole and the south pole that is rearward of a second one of the north pole and the south pole. The first sensing surface of the first magnetic sensor may face the second axis. The second sensing surface of the second magnetic sensor may face away from the second axis. In addition or in the alternative, the first sensing direction of the first magnetic sensor may be directed away from the second axis. The second sensing direction may be directed toward the second axis. Owing to such configuration, the second magnetic sensor can function similarly to a unipolar detection type sensor that detects the other pole that is different from the originally-designated pole to be detected by the second magnetic sensor. Specifically, the second magnetic sensor can detect (respond to) the second one of the north pole and the south pole that is located at the front. Thus, the second magnetic sensor can be activated when the magnetic flux density of the second pole at the front increases relatively sharply after the first pole at the rear passes though the sensing point of the second magnetic sensor. Further, the first magnetic sensor can function as a unipolar detection type sensor that detects the originally-designated pole to be detected by the first magnetic sensor. Specifically, the first magnetic sensor can detect (respond to) the first one of the north pole and the south pole that is located at the rear. Thus, the first magnetic sensor can be activated when the magnetic flux density of the first pole at the rear increases relatively sharply after the second pole at the front passes through the sensing point of the first magnetic sensor. Accordingly, the detection accuracies of the first magnetic sensor and the second magnetic sensor can be improved. In addition or in the alternative, the specified pole may be the north pole. Unipolar sensors that detect (respond to) the north pole are widely available. According to this configuration, such a unipolar sensor can be effectively utilized.

In addition or in the alternative to the preceding embodiments, the first magnetic sensor and the second magnetic sensor may be disposed at the same side of an imaginary plane that contains the second axis. According to this configuration, the first magnetic sensor and the second magnetic sensor can be disposed within a relatively small space in a direction that intersects the second axis.

In addition or in the alternative to the preceding embodiments, a distance between the magnet and a sensing point of the first magnetic sensor when the magnet and the first magnetic sensor are located on a first straight line that is perpendicular to the second axis may be equal to a distance between the magnet and a sensing point of the second magnetic sensor when the magnet and the second magnetic sensor are located on a second straight line that is perpendicular to the second axis. According to this configuration, the change of the magnetic field (the magnetic flux density) of the pole to be detected by the second magnetic sensor when the magnet comes closer to the second magnetic sensor from the front can be more reliably made similar to the change of the magnetic field of the pole to be detected by the first magnetic sensor when the magnet comes closer to the first magnetic sensor from the rear.

In addition or in the alternative to the preceding embodiments, the first magnetic sensor and the second magnetic sensor may be mounted on a first board and a second board that are separate (discrete) components (members), respectively. According to this configuration, the first magnetic sensor and the second magnetic sensor can be more flexibly mounted/arranged in the fastening tool.

In addition or in the alternative to the preceding embodiments, the first magnetic sensor and the second magnetic sensor may be sensors having an identical (the same) structure. According to this configuration, the change of the magnetic field (the magnetic flux density) of the pole to be detected by the second magnetic sensor when the magnet comes closer to the second magnetic sensor from the front can be more reliably made similar to the change of the magnetic field of the pole to be detected by the first magnetic sensor when the magnet comes closer to the first magnetic sensor from the rear.

In addition or in the alternative to the preceding embodiments, the fastening tool may be configured to be used with the fastener of a tear-off type in which the pin having a small-diameter portion to be broken is inserted into the tubular part. The pin-gripping part may be configured to fasten the workpieces via the fastener and to break the pin at the small-diameter portion by pulling the pin rearward relative to the tubular part while the pin-gripping part moves from the initial position to the stop position. According to this configuration, the pin-gripping part can be appropriately stopped at the stop position after a load applied to the pin-gripping part sharply decreases in response to the breakage of the pin.

A representative, non-limiting embodiment of the present disclosure is now described in detail with reference to the drawings. The following embodiment exemplarily describes a fastening tool 1, which is capable of fastening workpieces using a fastener.

The fastening tool 1 can selectively use multiple types of fasteners. A fastener 9 shown in FIG. 1 is an example of a fastener that can be used by the fastening tool 1. More specifically, the fastener 9 is an example of a known fastener that is called a multi-piece swage type fastener.

The structure of the fastener 9 is now briefly described. The fastener 9 includes a pin 91 and a collar 95. The pin 91 includes a shaft (shank) 911, and a head 915 that is formed integrally with the shaft 911, at one end of the shaft 911. The collar 95 is a hollow cylindrical member, into which the shaft 911 can be inserted. The pin 91 and the collar 95 are originally formed as separate (discrete) members. When the pin 91 is pulled in its axial direction relative to the collar 95 by the fastening tool 1 and thereby the collar 95 is deformed, workpieces W are fastened between the head 915 of the pin 91 and the collar 95 swaged onto the shaft 911 of the pin 91.

There are two types of the multi-piece swage type fasteners. The first type is a fastener of which a portion of the shaft of the pin (this portion is also referred to as a pintail or a mandrel) will be broken and torn off (hereinafter simply referred to as a tear-off or breakage type fastener). The second type is a fastener of which the shaft of the pin will be retained as it is without being torn off (hereinafter simply referred to as a non-tear-off type fastener). The fastener 9 is a tear-off type fastener. Thus, the shaft 911 of the fastener 9 has a small-diameter portion 913 (groove) to be broken.

The general structure of the fastening tool 1 is now described.

Figure 2:
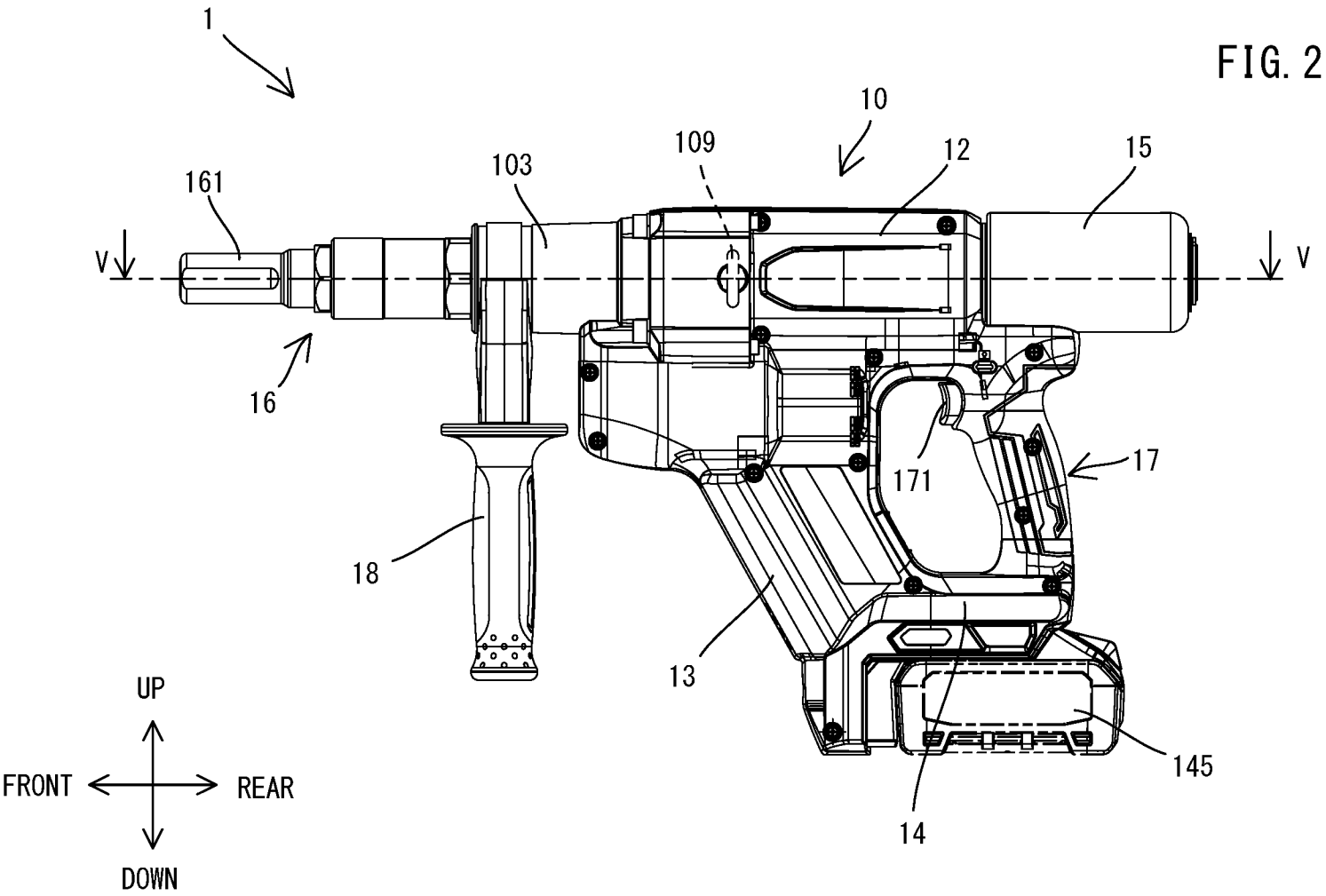
FIG. 2 is a left side view of the fastening tool on which an auxiliary handle is mounted.
Figure 3:
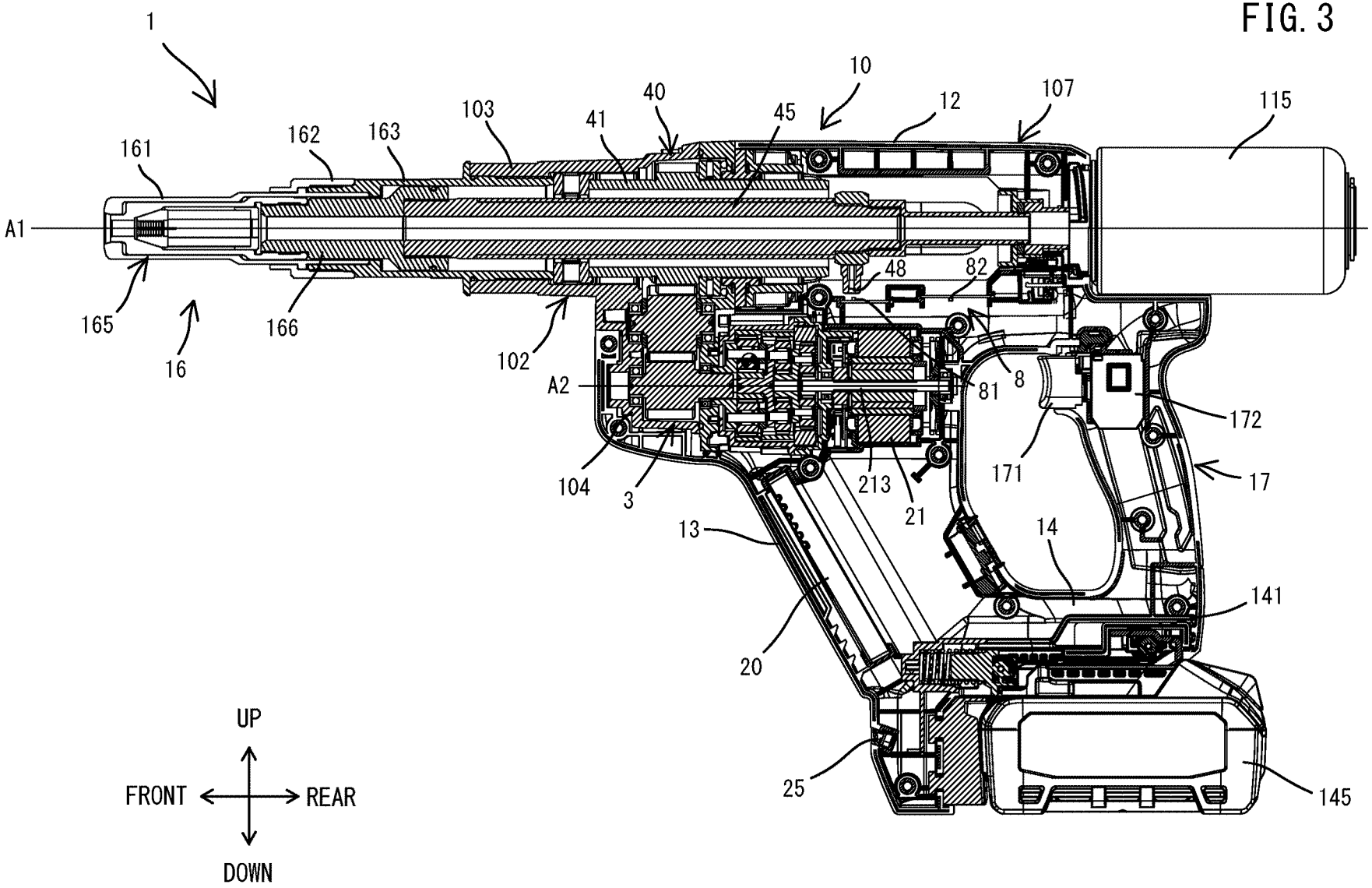
FIG. 3 is a cross-sectional view of the fastening tool in a state in which a screw shaft and a pin-gripping part are at their initial positions.

As shown in FIG. 2 and FIG. 3, the fastening tool 1 includes a tool body 10, a nose 16 and a handle 17.

The tool body 10 is also referred to as a housing. The tool body 10 houses a motor 21, a driving mechanism 3 and the like. A battery 145 is attachable to the tool body 10.

The fastening tool 1 is operated by electric power supplied from the battery 145. The nose 16 includes an anvil 161, and a pin-gripping part 165 disposed within the anvil 161. The anvil 161 is connected (coupled, mounted) to one end portion of the tool body 10 and extends along a driving axis A1. The handle 17 is an elongate tubular body and configured to be gripped by a user. The handle 17 is located at an opposite side of the tool body 10 from the anvil 161 in an extension direction of the driving axis A1, and extends in a direction that intersects (crosses) the driving axis A1 (specifically, in a direction that is generally perpendicular to the driving axis A1). The handle 17 has a trigger 171 that is configured to be manually pulled (depressed) by the user. In this embodiment, two opposite ends of the handle 17 are connected to the tool body 10, which has a generally C-shape. The tool body 10 and the handle 17 together form an annular portion (a ring or a loop) having a generally D-shape as a whole.

When the user engages the fastener 9 (see FIG. 1) with a front end portion of the anvil 161 and pulls (depresses) the trigger 171, the motor 21 is driven. With the power generated by the motor 21, the driving mechanism 3 strongly pulls the pin 91 rearward relative to the collar 95 and causes the fastener 9 to be deformed, so that the workpieces W are fastened via the deformed fastener 9.

In the following description, for convenience of explanation, directions of the fastening tool 1 are related in the following manner. The extension direction of the driving axis A1 is defined as a front-rear direction of the fastening tool 1. In the front-rear direction, the side on which the nose 16 is located is defined as a front side, and the opposite side (the side on which the handle 17 is located) is defined as a rear side. A direction that is perpendicular to the driving axis A1 and that generally corresponds to a longitudinal direction of the handle 17 is defined as an up-down direction. In the up-down direction, the side on which one longitudinal end of the handle 17 close to the driving axis A1 is located is defined as an upper side, and the opposite side (the side on which the other longitudinal end of the handle 17 far from the driving axis A1 is located) is defined as a lower side. A direction that is perpendicular to both of the front-rear direction and the up-down direction is defined as a left-right direction.

The detailed structure of the fastening tool 1 is now described.

Firstly, the detailed structure of the tool body 10 and structures (elements, components) disposed within the tool body 10 are described.

As shown in FIG. 2 and FIG. 3, the tool body 10 basically has a generally C-shape. The tool body 10 includes a housing part 12, an extending part 13 and a battery holding part 14. The housing part 12 extends along the driving axis A1. An upper front portion of the housing part 12 (also referred to as a barrel part 103) has a hollow cylindrical shape. An auxiliary handle 18 can be removably mounted around a front portion of the barrel part 103. The extending part 13 extends obliquely rearward and downward from a lower portion of the housing part 12 of the tool body 10. The battery holding part 14 extends rearward from a center portion in the up-down direction of the extending part 13. The battery holding part 14 is configured to removably hold the battery 145. In this embodiment, the battery 145 can be attached to the battery holding part 14 via a battery holder 141, which is supported in the battery holding part 14. However, the battery holding part 14 may be configured to directly and removably hold the battery 145.

As shown in FIG. 3, the tool body 10 mainly houses the motor 21, the driving mechanism 3, a position detection mechanism 8 and a control device 20.

The motor 21 is disposed in a lower rear end portion of the housing part 12. A rotational axis A2 of a motor shaft 213 extends parallel to the driving axis A1 (i.e., in the front-rear direction), directly below the driving axis A1. In this embodiment, a brushless DC motor is employed as the motor 21. The motor shaft 213 is rotatable in two directions, i.e., a normal direction and a reverse direction. The normal direction corresponds to a direction that causes a screw shaft 45 and the pin-gripping part 165 to move rearward. The reverse direction corresponds to a direction that causes the screw shaft 45 and the pin-gripping part 165 to move forward. In the following description, the driving of the motor 21 in which the motor shaft 213 rotates in the normal direction may be referred to as a normal driving. On the other hand, the driving of the motor 21 in which the motor shaft 213 rotates in the reverse direction may be referred to as a reverse driving.

Figure 4:
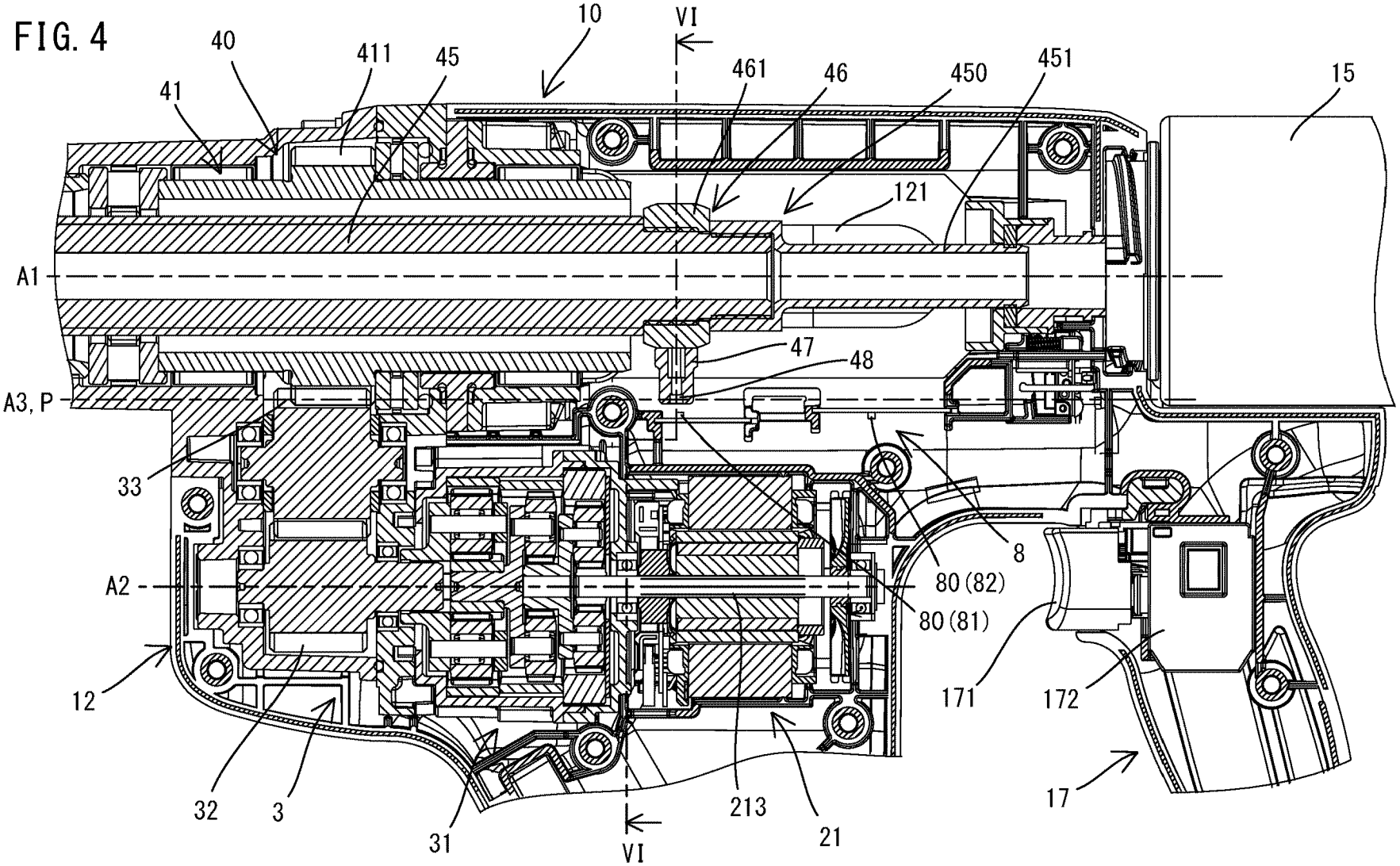
FIG. 4 is a partial enlarged view of FIG. 3.

The driving mechanism 3 is configured to be driven by the motor 21 to move the pin 91 of the fastener 9 relative to the collar 95 in the front-rear direction. More specifically, the driving mechanism 3 is configured to move the pin-gripping part 165, which is configured to grip the pin 91, along the driving axis A1 relative to the anvil 161, which is fixed to the tool body 10. As shown in FIG. 4, the driving mechanism 3 of this embodiment includes a planetary-gear speed reducer 31, a driving gear 32, an idle gear 33, and a ball-screw mechanism 40.

The planetary-gear speed reducer 31 is disposed coaxially with the motor 21 in front of the motor 21 within the housing part 12. The planetary-gear speed reducer 31 is a multiple-stage planetary-gear speed reducer. The driving gear 32 is disposed coaxially with the planetary-gear speed reducer 31 in front of the planetary-gear speed reducer 31. The planetary-gear speed reducer 31 is configured to increase torque inputted from the motor shaft 213 to rotate the driving gear 32. The idle gear 33 is disposed above the driving gear 32. The idle gear 33 meshes with the driving gear 32 and a driven gear 411 of a nut 41, which will be described below.

The ball-screw mechanism 40 is a motion converting mechanism that is configured to convert rotation into linear motion. The ball-screw mechanism 40 mainly includes the nut 41 and a screw shaft 45. In this embodiment, the ball-screw mechanism 40 is configured to convert rotation of the nut 41 into linear motion of the screw shaft 45 to thereby linearly move the pin-gripping part 165. The ball-screw mechanism 40 is disposed in an upper portion of the housing part 12.

The nut 41 is supported in the tool body 10 such that movement of the nut 41 relative to the tool body 10 in the front-rear direction is substantially restricted and rotation of the nut 41 relative to the tool body 10 around the driving axis A1 is allowed. The nut 41 has a hollow cylindrical shape. The nut 41 has the driven gear 411 formed integrally with an outer peripheral portion of the nut 41. The nut 41 is supported by two bearings, which are supported by the tool body 10 in front of and behind the driven gear 411, respectively.

The screw shaft 45 is engaged with the nut 41 such that rotation of the screw shaft 45 relative to the tool body 10 around the driving axis A1 is substantially restricted and movement of the screw shaft 45 relative to the tool body 10 in the front-rear direction along the driving axis A1 is allowed. More specifically, the screw shaft 45 is an elongate body that is inserted into the nut 41 so as to extend along the driving axis A1. Although not shown in detail, a track is defined by a spiral groove formed on an inner peripheral surface of the nut 41 and a spiral groove formed on an outer peripheral surface of the screw shaft 45. Balls are rollably disposed within the track. The screw shaft 45 is engaged with the nut 41 via these balls. An extension shaft 451 is fixed to the rear end portion of the screw shaft 45 and extends coaxially with the screw shaft 45. Thus, the extension shaft 451 is integrated with the screw shaft 45. The screw shaft 45 and the extension shaft 451 integrated with each other are hereinafter also collectively referred to as a driving shaft 450.

The driving shaft 450 has a through hole that extends through the driving shaft 450 along the driving axis A1. A container 15 is removably attached to the rear end portion of the tool body 10. The container 15 is configured to accommodate a portion of a shaft (a pintail) torn off from the pin 91 of the fastener 9. The pintail is torn off from the fastener 9 and travels through the through hole of the driving shaft 450 and reaches the container 15, so that the pintail is accommodated in the container 15.

Figure 5:
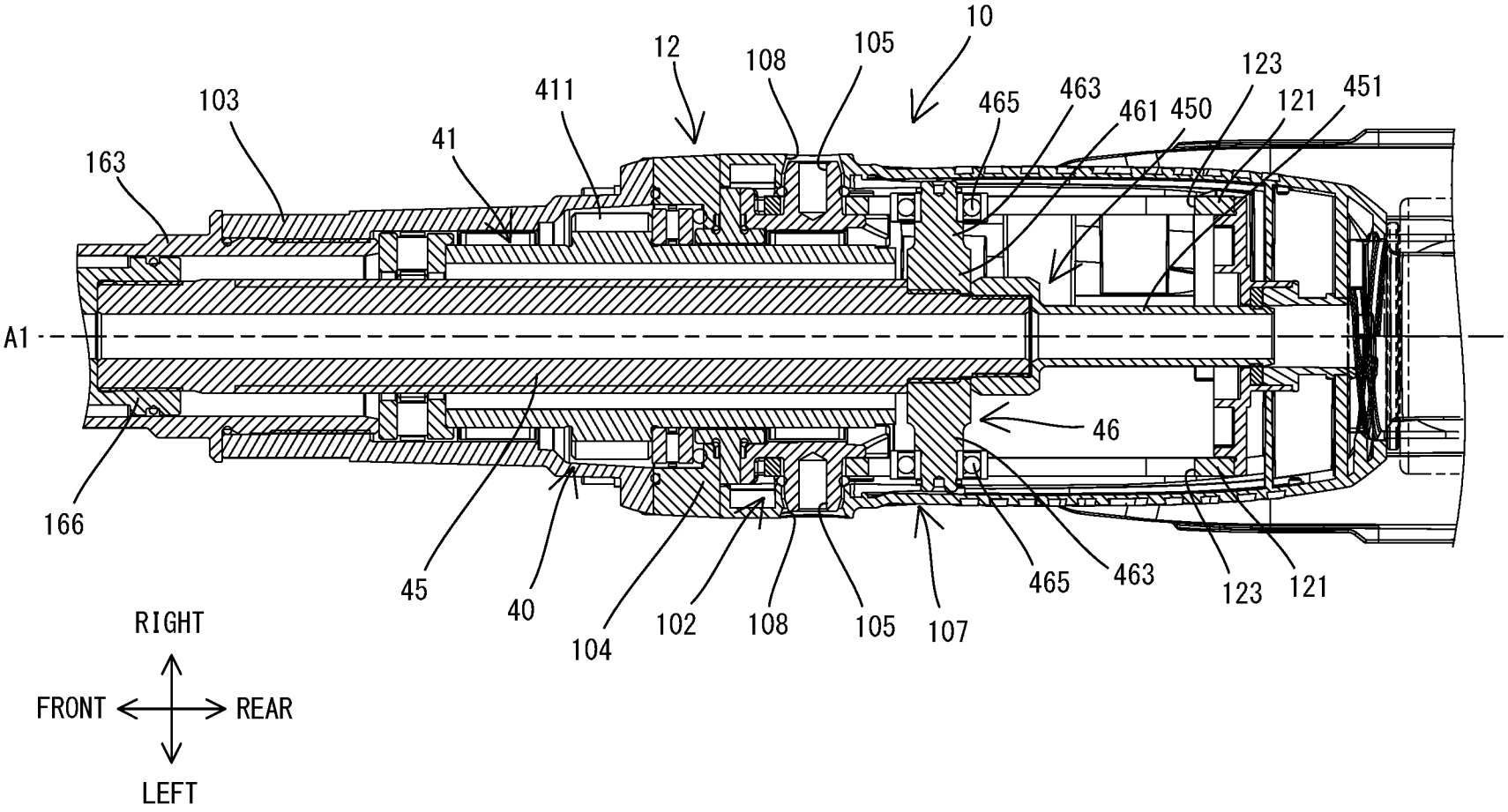
FIG. 5 is a partial cross-sectional view taken along line V-V in FIG. 2.
Figure 6:
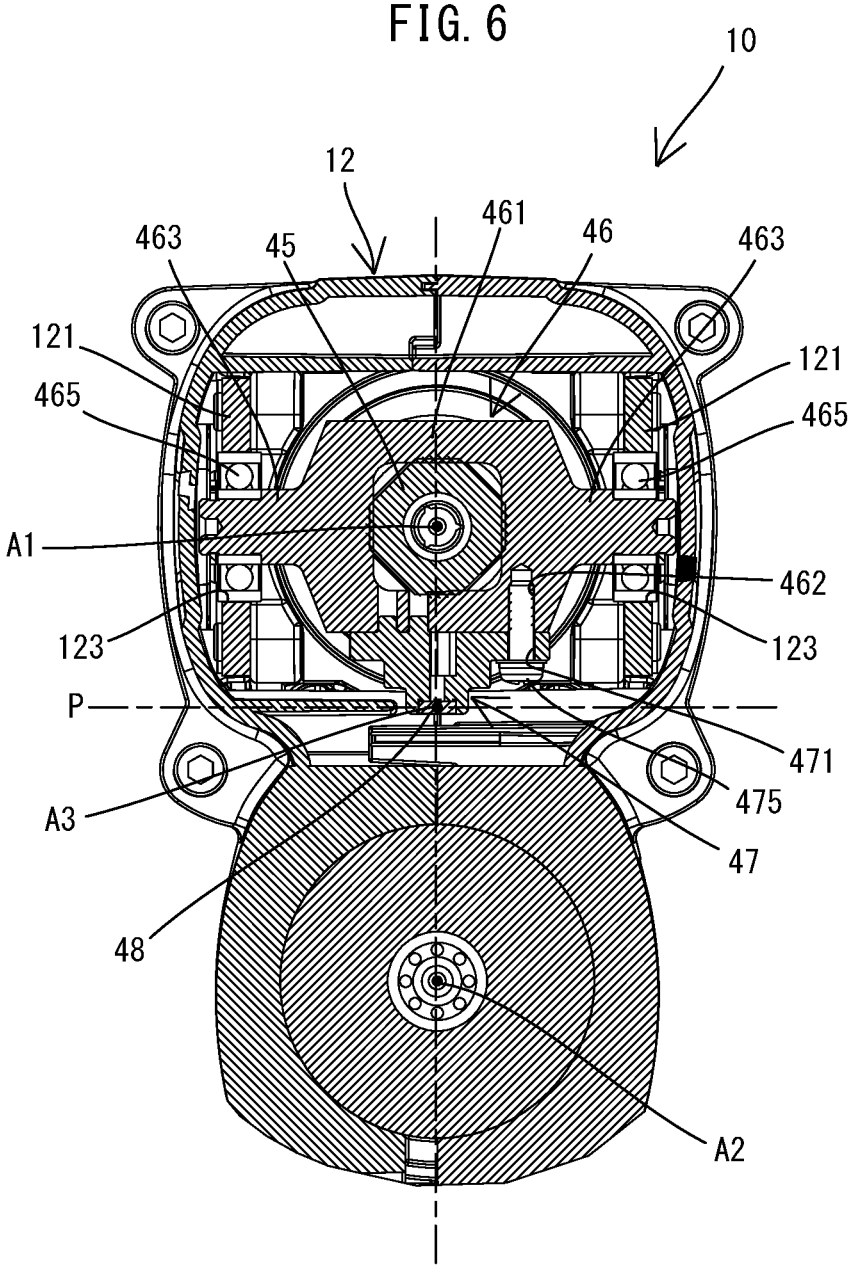
FIG. 6 is a cross-sectional view taken along line VI-VI in FIG. 4.

As shown in FIG. 4 to FIG. 6, a bearing holder 46 is connected to a rear end portion of the screw shaft 45. The bearing holder 46 has a base 461 that is disposed around the screw shaft 45, and two arms 463 that extend to the left and to the right, respectively, from the base 461. The base 461 is disposed between a rear surface of a shoulder portion formed on the rear end portion of the screw shaft 45 and a front end surface of the extension shaft 451, and is fixedly coupled to the screw shaft 45. Accordingly, the bearing holder 46 is integrated with the screw shaft 45 (the driving shaft 450). Bearings 465 are respectively mounted on distal end portions of the arms 463. Left and right guide plates 121 are fixed to the tool body 10 (the rear housing part 12). Each of the guide plates 121 has a guide groove 123 that extends in the front-rear direction. The left and right bearings 465 are disposed in the left and right guide grooves 123, respectively.

Owing to such a configuration, when the nut 41 rotates around the driving axis A1 in response to driving of the motor 21, the screw shaft 45 moves linearly in the front-rear direction relative to the nut 41 and the tool body 10.

Further, as shown in FIG. 4 and FIG. 6, a magnet holder 47 is connected to the lower end of the bearing holder 46. The magnet holder 47 is a holder (retainer) for a magnet 48. The magnet holder 47 is disposed below the bearing holder 46. The magnet holder 47 has a through hole 471 that extends through the magnet holder 47 in the up-down direction. A screw hole 462 that extends in the up-down direction is formed in a lower portion of the bearing holder 46 (the base 461). A screw 475 is screwed (fastened) into the screw hole 462 from the lower side of the magnet holder 47 via the through hole 471 of the magnet holder 47. Accordingly, the magnet holder 47 and the magnet 48 are fixedly coupled to the bearing holder 46 and thus integrated with the screw shaft 45 (the driving shaft 450) via the bearing holder 46. In this embodiment, the screw 475 is inserted in a direction that is perpendicular to the driving axis A1 (i.e. the movement direction of the screw shaft 45). Thus, the screw 475 is less easily loosened in response to the movement of the screw shaft 45, compared to a case in which the screw 475 is inserted in a direction that is parallel to the movement direction of the screw shaft 45.

The magnet holder 47 supports the magnet 48 such that the magnet 48 is exposed downward. In this embodiment, the magnet 48 is arranged such that the north pole (hereinafter referred to as the N-pole) is located at the rear and the south pole (hereinafter referred to as the S-pole) is located at the front. In other words, the N-pole of the magnet 48 is located rearward of the S-pole of the magnet 48 in the front-direction. Since the magnet holder 47 is integrated with the screw shaft 45, the center of the magnet 48 moves in the front-rear direction along a movement axis A3 (on the movement axis A3) that is parallel to the driving axis A1, while the screw shaft 45 moves in the front-rear direction along the driving axis A1.

The position detection mechanism 8 shown in FIG. 4 detects the magnetic field generated by the magnet 48 to thereby detect the position of the screw shaft 45 and thus detect the position of the pin-gripping part 165. In this embodiment, the position detection mechanism 8 includes two magnetic sensors 80 (specifically, a first sensor 81 and a second sensor 82) spaced apart from each other in the front-rear direction, and disposed in the vicinity of the movement axis A3 of the magnet 48. The detection results of the magnetic sensors 80 are used for the driving control of the motor 21 (the movement control of the pin-gripping part 165). The structure and arrangement of each of the magnetic sensors 80 and the control based on the detection results of the magnetic sensors 80 will be described in detail below.

As shown in FIG. 3, the extending part 13 houses the control device 20. Although not shown in detail, the control device 20 includes a control circuit mounted on a circuit board, and a driving circuit for the motor 21. In the present embodiment, the control circuit is a microcomputer including a CPU, a ROM, a RAM, etc. The control device 20 is electrically connected to the magnetic sensors 80 (i.e., the first sensor 81 and the second sensor 82), an LED light 25, a switch 172, etc., via wires not shown. The control device 20 controls the operation of the fastening tool 1, including the driving of the motor 21.

The LED light 25 is held in an opening formed on a front wall of the lower portion of the extending part 13. The LED light 25 illuminates a region (area) in front of the nose 16 (a region where the fastening operation via the fastener is performed).

As shown in FIG. 3 and FIG. 5, in this embodiment, the tool body 10 is formed by a metal housing 102 and a plastic housing 107. The metal housing 102 is made of metal (for example, aluminum alloy). The metal housing 102 includes the above-described barrel part 103, and a support part 104 that supports the driving gear 32, the idle gear 33 and the nut 41. The plastic housing 107 is made of synthetic resin (plastic, polymeric material). The plastic housing 107 is fixedly coupled to the metal housing 102 and thus integrated with the metal housing 102. The plastic housing 107 covers a large portion of the support part 104 of the metal housing 102.

Figure 7:
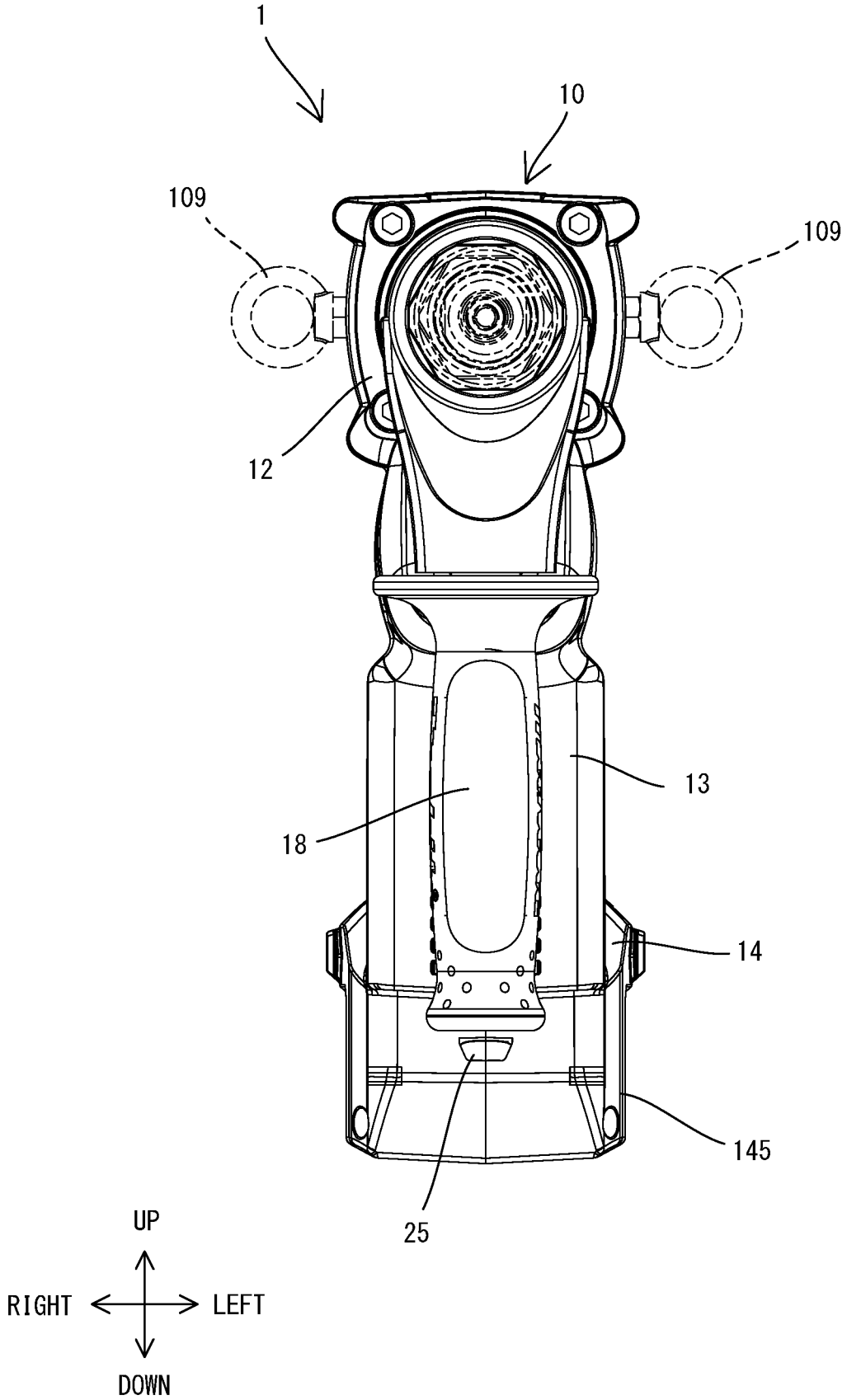
FIG. 7 is a front view of the fastening tool on which the auxiliary handle is mounted.

As shown in FIG. 5, the support part 104 of the metal housing 102 includes a portion that supports the nut 41. This portion has screw holes 105 formed on its left side and right side. Left and right wall parts of the plastic housing 107 has corresponding openings 108 that respectively expose the screw holes 105 to the outside. As shown in FIG. 2 and FIG. 7, an eyebolt 109 can be screwed into each of the screw holes 105. The user of the fastening tool 1 attaches an attachment tool (e.g., hook) of a shoulder belt (not shown) to a loop of the eyebolt 109 so that the user can hang the fastening tool 1 from the shoulder using the shoulder belt.

The nose 16 is now described. As shown in FIG. 3, the nose 16 mainly includes the anvil 161 and the pin-gripping part 165. The structures of the anvil 161 and the pin-gripping part 165 are well-known, and thus are only briefly described below.

The anvil 62 is an elongate hollow cylindrical body as a whole. The anvil 62 has a bore that extends along the driving axis A1. A distal (front) end portion of the bore has a smaller diameter than the remaining portion, and is configured to abut on (engaged with) the collar 95 of the fastener 9. The anvil 161 is coupled to the tool body 10 (the barrel part 103) via coupling members 162, 163.

The pin-gripping part 165 is configured to grip (hold) the pin 91 (the shaft 911) of the fastener 9. The pin-griping part 165 is held to be movable relative to the anvil 161 in the front-rear direction along the driving axis A1. More specifically, the pin-gripping part 165 is coaxially and slidably held by the anvil 161 within the bore. The pin-gripping part 165 may also be referred to as a jaw assembly. The pin-gripping part 165 has claws (also referred to as jaws) that are capable of gripping the shaft 911 of the pin 91. The ping-gripping part 165 is configured such that the gripping force of the claws increases as the pin-gripping part 165 moves rearward from an initial position (a position shown in FIG. 3) relative to the anvil 161. A rear end portion of the pin-gripping part 165 is coupled to the front end portion of the screw shaft 45 via a coupling member 166. Thus, the pin-gripping part 165 moves integrally with the screw shaft 45 in the front-rear direction. The coupling member 166 has a through hole that communicates with the through hole of the driving shaft 450.

The structures (elements, components) disposed within the handle 17 are now described.

As shown in FIG. 3, the switch 172 is disposed behind the trigger 171 within the handle 17. The switch 172 is normally kept OFF, and turned ON in response to depressing manipulation of the trigger 171. When the switch 172 is turned ON, the switch 172 outputs a specified signal (an ON signal) to the control device 20.

Figure 8:
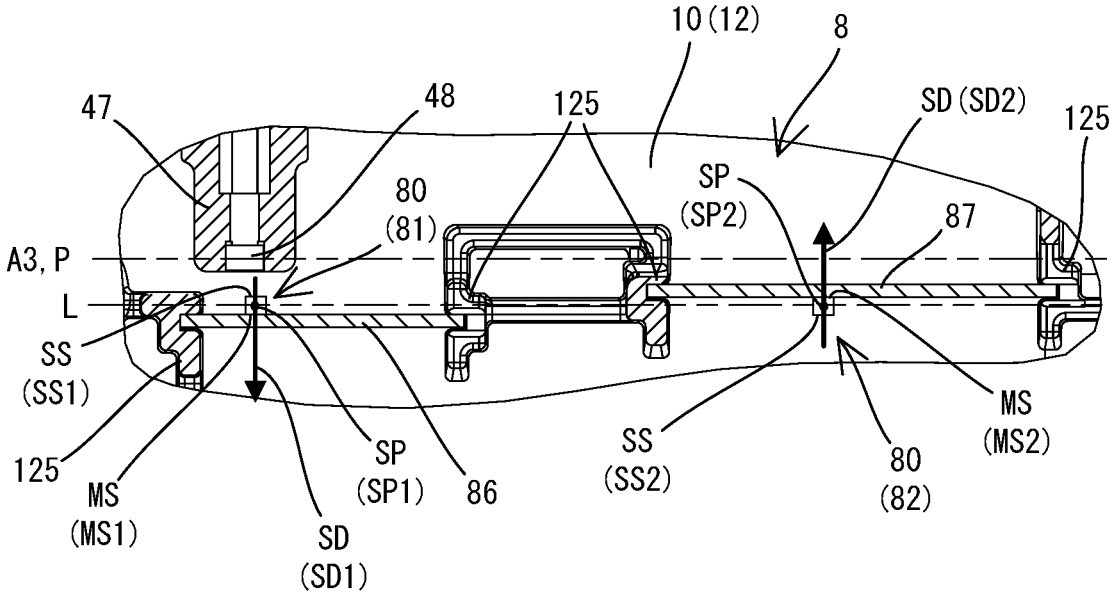
FIG. 8 is a partial enlarged view of a portion including a position detection mechanism in FIG. 4.

The detailed structure and arrangement of the magnetic sensors 80 of the position detection mechanism 8 are now described with reference to FIG. 8.

In this embodiment, the two magnetic sensors 80 of the position detection mechanism 8 are identical to each other. The magnetic sensor 80 is a sensor that is configured to detect presence/absence of the magnetic field and the strength (magnitude) of the magnetic field, based on the principle of Hall effect. In other words, the magnetic sensor 80 is a Hall effect sensor/a Hall sensor.

The magnetic sensor 80 of this embodiment is a Hall sensor of a so-called unipolar-detection, single-output type, which is configured to detect only one of the N-pole and the S-pole. More specifically, the magnetic sensor 80 is configured to respond to (to be activated by) only the N-pole of the magnet 48 (to detect the magnetic field of the N-pole). The magnetic sensor 48 is thus configured to detect a component of the magnetic field in one direction (a sensing direction (or a reference direction) SD), which is perpendicular to a sensing surface (or a main surface/a reference surface) SS and which is oriented from the sensing surface SS toward a mounting surface MS. Further, the magnetic sensor 80 is turned ON and OFF (switches an output signal between a LOW signal and a HIGH signal), depending on the strength (magnitude) of the magnetic field (magnetic flux density) that passes through a sensing point SP of the magnetic sensor 80 and penetrates the magnetic sensor 80 in the sensing direction SD. Specifically, when the magnetic flux density exceeds a threshold, the magnetic sensor 80 is turned ON (outputs the LOW signal). On the other hand, when the magnetic flux density is equal to or less than a threshold, the magnetic sensor 80 is turned OFF (outputs the HIGH signal). It is noted that, the threshold at which the magnetic sensor 80 is turned OFF may be the same as or different from the threshold at which the magnetic sensor 80 is turned ON.

The two magnetic sensors 80 are disposed at the same side of an imaginary plane that contains the movement axis A3 of the magnet 48, and are spaced apart from each other in the front-rear direction. More specifically, both of the magnetic sensors 80 are at the lower side of (below) an imaginary plane P. The imaginary plane P contains the movement axis A3 of the magnet 48 and is perpendicular to the up-down direction. Accordingly, the two magnetic sensors 80 can be arranged within a small space in the up-down direction, using a spare (free, vacant) space within the housing part 12 below the screw shaft 45. The sensing points SP of the magnetic sensors 80 are located on a straight line L that extends parallel to the movement axis A3 (i.e., in the front-rear direction) directly below the movement axis A3.

In the following description, when referring to the two magnetic sensors 80 collectively or referring to either one of the two magnetic sensors 80 without distinction, the magnetic sensor(s) 80 may be simply referred to as the magnetic sensor(s) 80. On the other hand, when referring to specific one of the magnetic sensors 80, a front one of the magnetic sensors 80 may be referred to as a first sensor 81 and a rear one of the magnetic sensors 80 may be referred to as a second sensor 82. Further, the sensing surface SS, the mounting surface MS, the sensing point SP, and the sensing direction SD of the first sensor 81 may be referred to as a sensing surface SS1, a mounting surface MS1, a sensing point SP1, and a sensing direction SD1, respectively. The sensing surface SS, the mounting surface MS, the sensing point SP, and the sensing direction SD of the second sensor 82 may be referred to as a sensing surface SS2, a mounting surface MS2, a sensing point SP2, and a sensing direction SD2, respectively.

The first sensor 81 and the second sensor 82 are mounted on a first board (circuit board) 86 and a second board (circuit board) 87, respectively. The first board 86 and the second board 87 are supported within the tool body 10 (the housing part 12). More specifically, the first board 86 and the second board 87 are each supported by support ribs 125 that protrude inward in the tool body 10 from side wall parts of the tool body 10 (the housing part 12).

Further, the first board 86 and the second board 87 are arranged such that an orientation of the sensing surface SS1 (the sensing direction SD1) of the first sensor 81 relative to the movement axis A3 of the magnet 48 is opposite to an orientation of the sensing surface SS2 (the sensing direction SD2) of the second sensor 82 relative to the movement axis A3. Further, in this embodiment, the sensing surface SS1 of the first sensor 81 at the front is parallel to the sensing surface SS2 of the rear second sensor 82. In addition, the sensing surface SS1 and the sensing surface SS2 face opposite directions from each other. Thus, the sensing direction SD1 of the first sensor 81 and the sensing direction SD2 of the second sensor 82 are opposite directions (oppositely oriented) and both substantially perpendicular to the movement axis A3.

More specifically, the first board 86 is disposed such that the sensing surface SS1 of the first sensor 81 faces upward. Thus, the sensing surface SS1 of the first sensor 81 faces the movement axis A3 and the magnet 48 in the up-down direction. The sensing direction SD1 of the first sensor 81 is a downward direction (i.e., a direction away from the movement axis A3). This orientation of the first sensor 81 is an orientation that is originally designated for use of the magnetic sensor 80, which responds to (detects) the N-pole only.

The second board 87 is disposed such that the sensing surface SS2 of the second sensor 87 faces downward. Thus, the sensing surface SS2 faces away from the movement axis A3 and the magnet 48 in the up-down direction. The sensing direction SD2 of the second sensor 82 is an upward direction (i.e., a direction toward the movement axis A3). Thus, the second sensor 82 is oriented in a direction that is opposite to an originally-designated direction. Specifically, the second sensor 82 is oriented such that the mounting surface MS2 faces the movement axis A3 and the magnet 48. Owing to such an arrangement, the second sensor 82 performs a function that is substantially identical to that of a Hall sensor of a unipolar detection type that responds to (is activated by) only the S-pole (i.e., that detects the magnetic field of the S-pole only) of the magnet that faces the mounting surface MS2.

Figure 9:
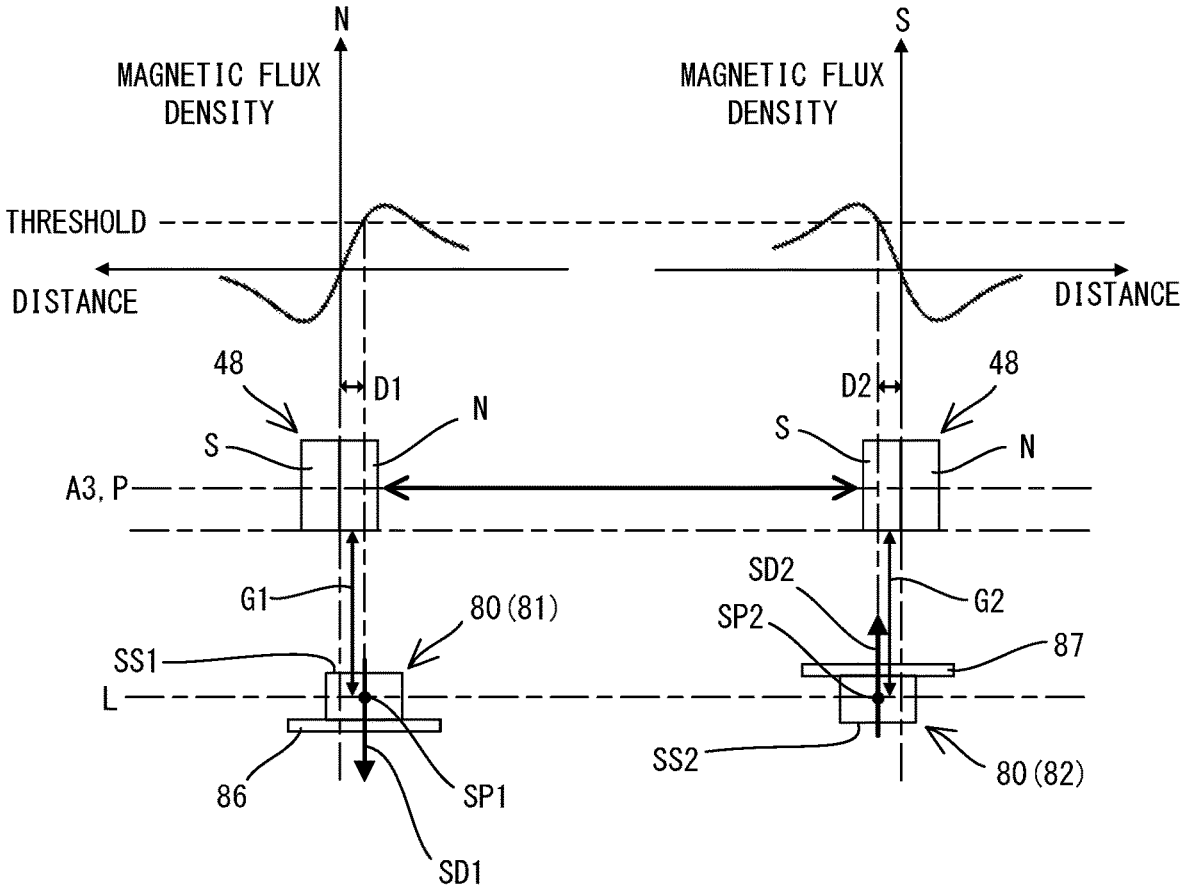
FIG. 9 is a schematic view for explaining positional relationship between a magnet and a first sensor/a second sensor, and a corresponding change of magnetic flux density.

As shown in FIG. 9, a distance (gap) G1 between the magnet 48 and the sensing point SP1 when the magnet 48 and the first sensor 81 are aligned on a straight line in the up-down direction is equal to a distance (gap) G2 between the magnet 48 and the sensing point SP2 when the magnet 48 and the second sensor 82 are aligned on another straight line in the up-down direction. In this embodiment, since the first board 86 and the second board 87 are separate boards, the first board 86 and the second board 87 can be flexibly mounted in the tool body 10. Accordingly, the first board 86 and the second board 87 can be easily arranged such that the distance G1 and the distance G2 are equal to each other.

The first sensor 81 is tuned ON when the magnet 48, which moves integrally with the screw shaft 45 and the pin-gripping part 165, reaches a specified first position relative to the first sensor 81. The second sensor 82 is tuned ON when the magnet 48 reaches a specified second position relative to the second sensor 82. The output signals of the first sensor 81 and the second sensor 82 are transmitted to the control device 20 via wires, which are not shown.

The action of the fastening tool 1 when performing a fastening operation, in which the workpieces W are fastened using the fastener 9, is now described. In the fastening operation, the screw shaft 45 and the pin-gripping part 165 perform a cycle of operations. The cycle includes: (i) a forward stroke (a normal/pulling stroke) in which the screw shaft 45 and the pin-gripping part 165 move rearward from their initial positions shown in FIG. 3 to their stop positions shown in FIG. 10; and (ii) a backward stroke (a reverse/return stroke) in which the screw shaft 45 and the pin-gripping part 165 move forward from their stop positions to their initial positions.

As shown in FIG. 3, in an initial state in which the trigger 171 is not yet pulled (depressed), the screw shaft 45 (the driving shaft 450) and the pin-gripping part 165 are at their initial positions. The user temporarily fixes the fastener 9 (see FIG. 1) to the workpieces W and inserts the shaft 911 of the pin 91 into the front end portion (between the jaws) of the pin-gripping part 165 to cause the pin-gripping part 165 to loosely grip the shaft 911. When the user pulls the trigger 171, the control device 20 (the control circuit) energizes the motor 21 in response to the ON signal from the switch 172 and starts the normal driving of the motor 21. Accordingly, the forward stroke is started.

The motor shaft 213 rotates in the normal direction. The rotation of the motor shaft 213 is transmitted to the nut 41 by way of the planetary-gear speed reducer 31, the driving gear 32, and the idle gear 33. The screw shaft 45 and the pin-gripping part 165 move rearward relative to the tool body 10 and the anvil 161 while the nut 41 rotates. The shaft 911 of the pin 91 is firmly gripped by the pin-gripping part 165 and pulled rearward relative to the collar 95 and the workpieces W.

Figure 10:
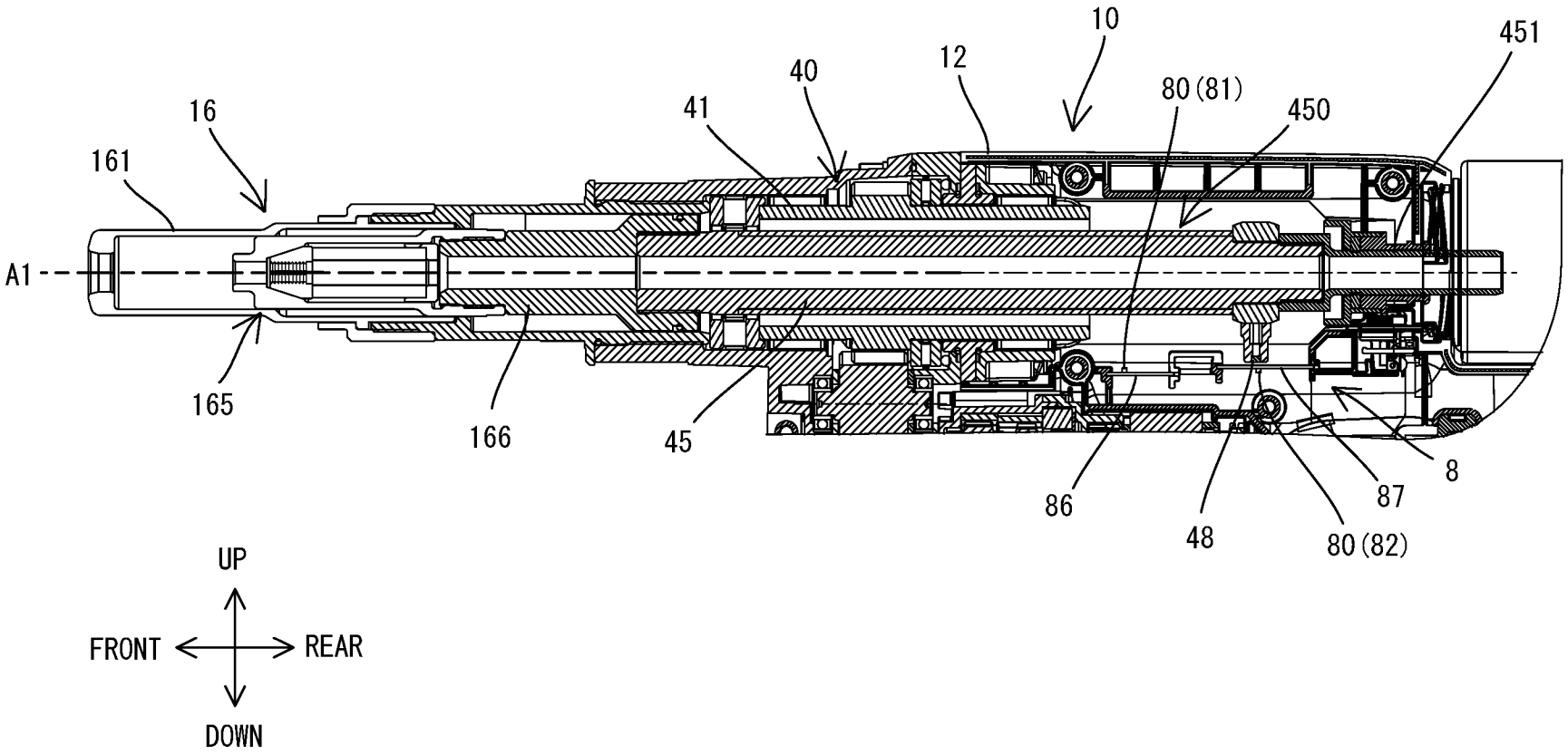
FIG. 10 is a partial cross-sectional view of the fastening tool in a state in which the screw shaft and the pin-gripping part are at their stop positions.

The collar 95 is deformed and thus swaged onto the shaft 911 of the pin 91. After the workpieces W are thus firmly clamped between the collar 95 and the head 915 of the pin 91, the shaft 911 is broken at the small-diameter portion 913 and the pintail is torn off, and accordingly the fastening of the workpieces W is completed. As shown in FIG. 10, the control device 20 stops the normal driving of the motor 21 when the screw shaft 45 and the pin-gripping part 165 reach their specified stop positions.

In this embodiment, the control device 20 is configured to determine whether or not the screw shaft 45 and the pin-gripping part 165 are at their stop positions, based on the detection result of the second sensor 82. More specifically, when the magnet 48 approaches the second sensor 82 from the front and the second sensor 82 is turned ON (when the control device 20 obtains the LOW signal outputted from the second sensor 82), the control device 20 determines that the screw shaft 45 and the pin-gripping part 165 have reached the stop positions, and then brakes and stops the motor 21. Accordingly, the forward stroke is completed.

When the user cancels the depressing of the trigger 171 and thus the switch 172 is turned OFF, the control device 20 starts the reverse driving of the motor 21. Accordingly, the backward stroke is started.

The nut 45 rotates in a direction opposite to that in the forward stroke while the motor shaft 213 rotates in the reverse direction. Thus, the screw shaft 45 and the pin-gripping part 165 move forward relative to the tool body 10 and the anvil 161. As shown in FIG. 3, the control device 20 stops the reverse driving of the motor 21 when the screw shaft 45 and the pin-gripping part 165 reach their initial positions.

In this embodiment, the control device 20 is configured to determine whether or not the screw shaft 45 and the pin-gripping part 165 are at their initial positions, based on the detection result of the first sensor 81. More specifically, when the magnet 48 approaches the first sensor 81 from the rear and the first sensor 81 is turned ON (when the control device 20 obtains the LOW signal outputted from the first sensor 81), the control device 20 determines that the screw shaft 45 and the pin-gripping part 165 have reached their initial positions, and then brakes and stops the motor 21. Accordingly, the backward stroke is completed and thus the fastening operation is completed.

In this embodiment, owing to the configuration and arrangement of the magnet 48 and the two magnetic sensors 80, a correlation (relationship) between (i) the change of the distance between the magnetic sensor 80 and the magnet 48 and (ii) the changes of the direction of the magnetic field relative to the sensing direction SD and the strength of the magnetic field (the magnetic flux density) is substantially the same in the forward stroke and in the backward stroke. The reason is described in detail below.

In this embodiment, the target of the first sensor 81 and the second sensor 82 is the single magnet 48. The N-pole and the S-pole of the magnet 48 are aligned in the movement direction of the magnet 48 (i.e., in the front-rear direction), and the N-pole is located rearward of the S-pole. Thus, in the forward stroke, the surface of the N-pole of the magnet 48 comes closer to (approaches) the second sensor 82, earlier than the surface of the S-pole of the magnet 48. On the other hand, in the backward stroke, the surface of the S-pole of the magnet 48 comes closer to (approaches) the first sensor 81, earlier than the surface of the N-pole of the magnet 48.

FIG. 9 specifically shows the relationship between the distance between the first sensor 81 and the magnet 48 and the magnetic flux density in the forward stroke, and the relationship between the distance between the second sensor 82 and the magnet 48 and the magnetic flux density in the backward stroke. The distance (horizontal axis) in each graph in FIG. 9 denotes the distance between the sensing point SP of each magnetic sensor 80 and the center of the magnet 48 (the boundary between the N-pole and the S-pole) in the movement direction of the magnet 48 (i.e. in the front-rear direction). Further, an upper region in each graph denotes a magnetic field that passes through each sensing point SP and penetrates each magnetic sensor 80 in the sensing direction SD. A lower region in each graph denotes a magnetic field that passes through each sensing point SP and penetrates each magnetic sensor 80 in the direction opposite to the sensing direction SD. Thus, the upper region in the graph of the first sensor 81 corresponds to the magnetic field of the N-pole and the lower region corresponds to the magnetic field of the S-pole, while the upper region in the graph of the second sensor 82 corresponds to the magnetic field of the S-pole and the lower region corresponds to the magnetic field of the N-pole.

As shown in FIG. 9, the relation between the distance and the magnetic flux density in each of the first sensor 81 and the second sensor 82 shows an S-shape curve. As described above, the first sensor 81 and the second sensor 82 are the Hall sensors having the same structure, and are arranged such that the sensing direction SD1 and the sensing direction SD2 are oriented in opposite directions and the distance G1 and the distance G2 between the respective sensing point SP and the magnet 48 are equal to each other. Therefore, the curve of the first sensor 81 has a same shape reversed from the curve of the second sensor 82, in relation to movement of the magnet 48 in the front-rear direction.

More specifically, in the curve of the second sensor 82, the magnetic flux density in the direction opposite to the sensing direction SD2 (i.e., the magnetic flux density of the N-pole) gradually increases and then sharply decreases, before the center of the magnet 48 reaches directly above the sensing point SP2 of the second sensor 82 in the forward stroke. After the center of the magnet 48 (and thus the N-pole) passes through the sensing point SP2 toward the rear, the magnetic flux density in the sensing direction SD2 (i.e., the magnetic flux density of the S-pole) sharply increases and then gradually decreases. Since the second sensor 82 substantially functions as a Hall sensor responsive to the S-pole, the second sensor 82 is turned ON when the magnetic flux density of the S-pole exceeds the threshold while the magnetic flux density sharply increases. At this time, the center of the magnet 48 is located rearward of the sensing point SP2 of the second sensor 82, and spaced apart from the sensing point SP2 by a distance D2.

On the other hand, in the curve of the first sensor 81, the magnetic flux density in the direction opposite to the sensing direction SD1 (i.e., the magnetic flux density of the S-pole) gradually increases and then sharply decreases, before the center of the magnet 48 reaches directly above the sensing point SP1 of the first sensor 81 in the backward stroke. After the center of the magnet 48 (and thus the S-pole) passes through the sensing point SP1 toward the front, the magnetic flux density in the sensing direction SD1 (i.e., the magnetic flux density of the N-pole) sharply increases and then gradually decreases. The first sensor 81, which is a Hall sensor responsive to the N-pole, is turned ON when the magnetic flux density of the N-pole exceeds the threshold while the magnetic flux density sharply increases. At this time, the center of the magnet 48 is located forward of the sensing point SP1 of the first sensor 81, and spaced apart form the sensing point SP1 by a distance D1.

Owing to the relationship between the curve of the first sensor 81 and the curve of the second sensor 82, the distance D1 and the distance D2 are equal to each other. Thus, the first sensor 81 and the second sensor 82 are tuned ON when the center of the magnet 48 moves the same distance after passing through the sensing points SP1 and SP2, respectively. Accordingly, a positional relationship between the first sensor 81 and the magnet 48 when the first sensor 81 is activated is substantially identical to a positional relationship between the second sensor 82 and the magnet 48 when the second sensor 82 is activated.

Figure 11:
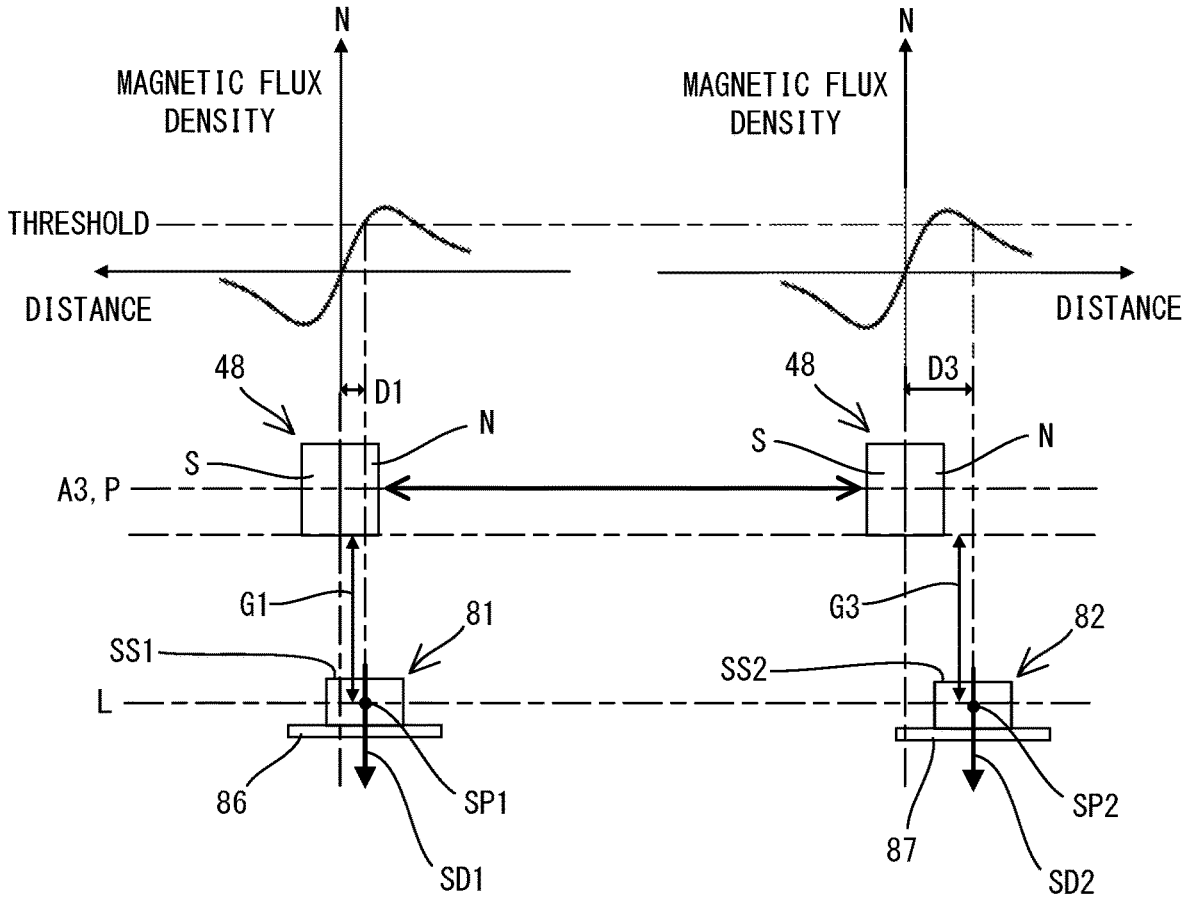
FIG. 11 is a schematic view of a comparative example for explaining comparative positional relationship between the magnet and the first sensor/the second sensor, and a corresponding change of magnetic flux density.

Here, a comparative example relating to the arrangement of the first sensor 81 and the second sensor 82 is described with reference to FIG. 11. As shown in FIG. 11, in the comparative example, the first sensor 81 and the second sensor 82 are arranged such that the sensing directions SD1 and SD2 are both oriented in their originally-designated directions (i.e., in the downward direction) and the distance G1 between the sensing point SP1 and the magnet 48 is identical to a distance G3 between the sensing point SP2 and the magnet 48. In this manner, in the comparative example, only the arrangement (orientation) of the second sensor 82 is different from that in the above-described embodiment.

In this comparative example, the curve of the first sensor 81 has the same shape and is oriented in the same direction (i.e., not reversed) as the curve of the second sensor 82, in relation to the movement of the magnet 48 in the front-rear direction. Therefore, in the curve of the second sensor 82, the magnetic flux density in the sensing direction SD2 (i.e., the magnetic flux density of the N-pole) gradually increases and then sharply decreases, before the center of the magnet 48 reaches directly above the sensing point SP2 of the second sensor 82 in the forward stroke. After the center of the magnet 48 (and thus the N-pole) passes through the sensing point SP2 toward the rear, the magnetic flux density in the direction opposite to the sensing direction SD2 (i.e., the magnetic flux density of the S-pole) sharply increases and then gradually decreases. The second sensor 82, which is a Hall sensor that is responsive to the N-pole, is turned ON when the magnetic flux density of the N-pole exceeds a threshold while the magnetic flux density gradually increases. At this time, the center of the magnet 48 does not yet reach the sensing point SP2 of the second sensor 82. Specifically, the center of the magnet 48 is frontward of the sensing point SP2, and spaced apart from the sensing point SP2 by a distance D3. The distance D3 is larger than the distance D1.

As described above, in the comparative example, the positional relationship between the first sensor 81 and the magnet 48 when the first sensor 81 is activated is different from the positional relationship between the second sensor 82 and the magnet 48 when the second sensor 82 is activated. Therefore, it is necessary to consider the above-described difference when designing the dimensions of various components.

On the contrary, the above-described configuration and arrangement of the first sensor 81 and the second sensor 82 in the embodiment facilitates designing the dimensions and thus results in less dimensional errors. Therefore, position detection accuracy can be improved, compared to the above-described comparative example, and thus the screw shaft 45 and the pin-gripping part 165 can be stopped appropriately at their stop positions and at their initial positions. In the fastening tool 1 that is used with the tear-off type fastener 9, the motor 21 rotates at high speed after the pin 91 is broken while the pin-gripping part 165 moves from the initial position to the stop position, and thus it is preferable to stop the motor 21 substantially immediately when the pin-gripping part 165 reaches the stop position. Also, it is necessary to accurately stop the pin-gripping part 165 at the initial position in order for the pin-gripping part 165 to grip the pin 91 at the initial position with an appropriate gripping force. Thus, it is favorable to improve the position detection accuracy in the fastening tool 1 that uses the tear-off type fastener 9.

Further, in this embodiment, as described above, each of the first sensor 81 and the second sensor 82 is activated in response to the magnetic flux density exceeding the threshold while the magnetic flux density of the corresponding pole to be detected relatively sharply increases (i.e., in a stage corresponding to a relatively steeply inclined portion of the curve of the magnetic flux density) in response to a slight change of the distance. Thus, the position detection accuracies of the first sensor 81 and the second sensor 82 can be improved, compared to a configuration in which the sensor is activated while the magnetic flux density gradually increases.

Correspondences between the features of the above-described embodiment and the claimed features are as follows. The features of the above-described embodiments are merely exemplary and do not limit the features of the present disclosure or the present invention.

The fastening tool 1 is an example of the "fastening tool". The fastener 9, the pin 91 and the collar 95 are examples of the "fastener", the "pin" and the "tubular part", respectively. The motor 21 is an example of the "motor". The anvil 161 and the pin-gripping part 165 are examples of the "anvil" and the "pin-gripping part", respectively. The magnet 48 is an example of the "magnet". The first sensor 81 and the second sensor 82 are examples of the "first magnetic sensor" and the "second magnetic sensor", respectively. The control device 20 (the control circuit) is an example of the "control device". The sensing surfaces SS1 and SS2 are examples of the "first sensing surface" and the "second sensing surface", respectively. The sensing directions SD1 and SD2 are examples of the "first sensing direction" and the "second sensing direction", respectively. The sensing point SP (SP1, SP2) is an example of the "sensing point". The first board 86 and the second board 87 are examples of the "first board" and the "second board", respectively.

The above-described embodiment is merely an exemplary embodiment, and therefore the fastening tool according to the present disclosure is not limited to the fastening tool 1. For example, the following modifications may be made. Further, at least one of these modifications may be employed in combination with at least one of the features of the fastening tool 1 described in the embodiment and the features recited in the claims.

First, exemplary modifications that can be employed in the position detection mechanism 8 (the first sensor 81 and the second sensor 82) and the magnet 48 are described.

For example, a magnetic sensor of a different type may be employed as each of the first sensor 81 and the second sensor 82. For example, each of the first sensor 81 and the second sensor 82 may be a Hall sensor of a unipolar detection type that detects (respond to) only the S-pole. In this modification, it is preferable that the magnet 48 is arranged such that the S-pole is disposed rearward of the N-pole, from a viewpoint of the position detection accuracy. Further, although it is preferable that the first sensor 81 and the second sensor 82 have the same structure (i.e., the first sensor 81 and the second sensor 82 are identical sensors), it is sufficient as long as the first sensor 81 and the second sensor 82 are magnetic sensors of a unipolar detection type that detect the same pole.

The first sensor 81 and the second sensor 82 may be arranged at any positions other than below the movement axis A3 of the magnet 48, as long as the orientation of the sensing surface SS1 (the sensing direction SD1) relative to the movement axis A3 of the magnet 48 is opposite to the orientation of the sensing surface SS2 (the sensing direction SD2) relative to the movement axis A3 of the magnet 48. For example, both of the first sensor 81 and the second sensor 82 may be disposed above, rightward of, or leftward of the movement axis A3.

Figure 12:
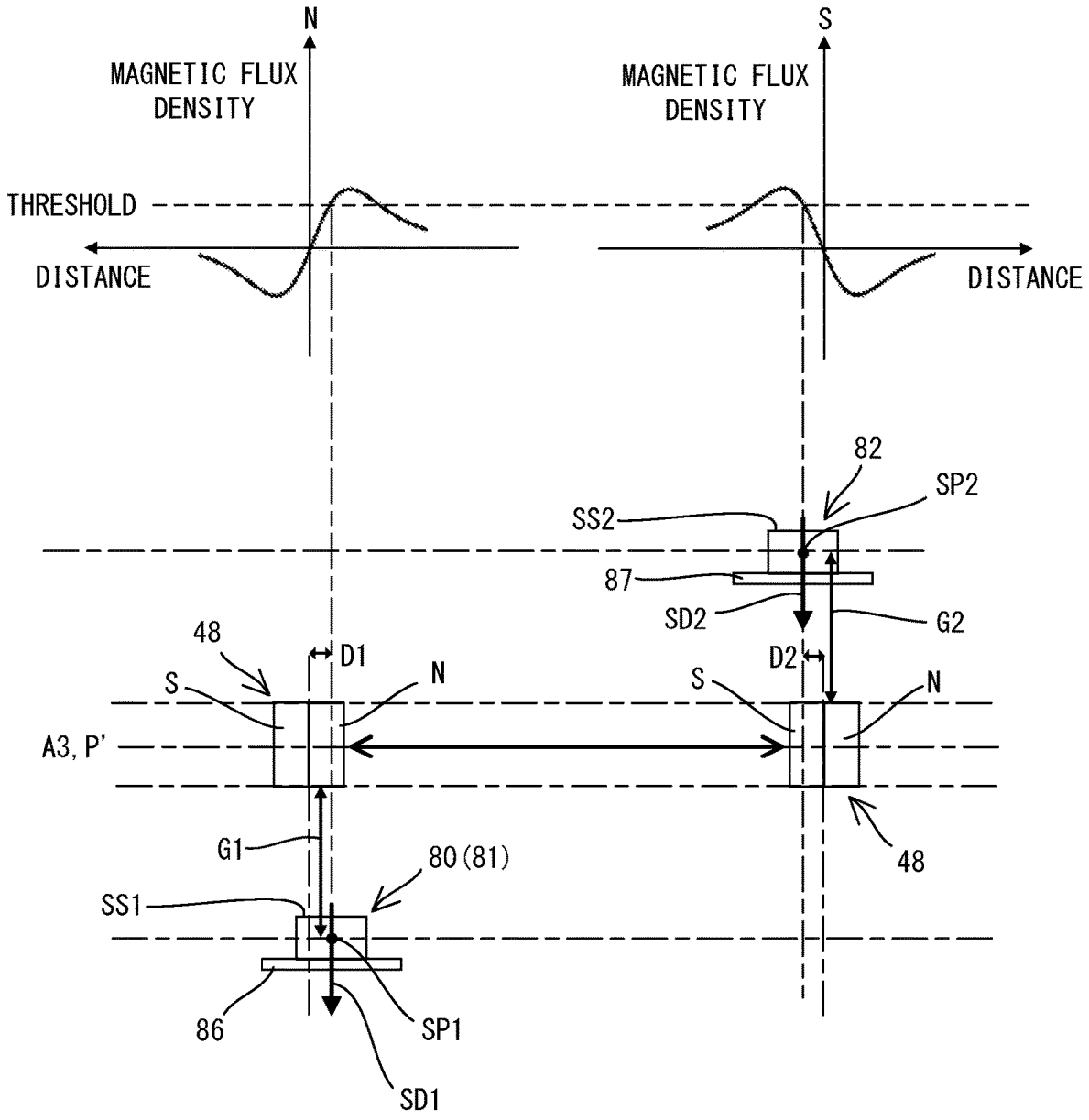
FIG. 12 is a schematic view of a modified embodiment for explaining modified positional relationship between a magnet and a first sensor/a second sensors and a corresponding change of a magnetic flux density.

The first sensor 81 and the second sensor 82 may be arranged at opposite sides of a plane that contains the movement axis A3 of the magnet 48. It is noted that this plane is not limited to the plane P exemplarily described in the above embodiment. For example, FIG. 12 shows a modified embodiment. As shown in this modified embodiment, the first sensor 81 and the second sensor 82 may be respectively arranged at the left side and the right side of a plane P',' which contains the movement axis A3 and which is perpendicular to the left-right direction (i.e., the plane P' extends in the up-down direction). The distance G1 between the magnet 48 and the sensing point SP1 is equal to the distance G2 between the magnet 48 and the sensing point SP2. The sensing surface SS1 of the first sensor 81 faces the movement axis A3. The sensing direction SD1 is oriented away from the movement axis A3 (i.e., oriented in the leftward direction). The sensing surface SS2 of the second sensor 82 faces away from the movement axis A3, contrary to the first sensor 81. The sensing direction SD2 is oriented toward the movement axis A3 (i.e., oriented in the leftward direction). According to this modified embodiment, similar to the above-described embodiment, a correlation (relationship) between (i) the change of the distance between the magnetic sensor 80 and the magnet 48 and (ii) the changes of the direction of the magnetic field relative to the sensing direction SD and the strength (magnitude) of the magnetic field (the magnetic flux density) can be made substantially the same in the forward stroke and the backward stroke.

In addition, the first sensor 81 and the second sensor 82 need not be arranged such that the sensing surface SS1 (the sensing direction SD1) and the sensing surface SS2 (the sensing direction SD2) are in parallel to each other and are oriented in the opposite directions from each other. Specifically, the sensing surface SS1 and the sensing surface SS2 may respectively extend along two planes that intersect each other. Although not shown, for example, a first one of the first sensor 81 and the second sensor 82 may be disposed above or below the movement axis A3 such that the sensing direction SD coincides with the up-down direction. Further, a second one of the first sensor 81 and the second sensor 82 may be disposed leftward or rightward of the movement axis A3 such that the sensing direction SD coincides with the left-right direction.

The first sensor 81 and the second sensor 82 need not necessarily be arranged such that the sensing surfaces SS1 and SS2 are in parallel to the movement axis A3 of the magnet 48 (i.e., the sensing directions SD1 and SD2 are perpendicular to the movement axis A3). Thus, the sensing surfaces SS1 and SS2 (the sensing directions SD1 and SD2) may be inclined relative to the movement axis A3, as long as a component of the magnetic field perpendicular to the sensing surfaces SS1 and SS2 (a component of the magnetic field parallel to the direction directions SD1 and SD2) can be appropriately detected.

The first sensor 81 and the second sensor 82 may be mounted on a single (same) circuit board. For example, in a case in which the first sensor 81 and the second sensor 82 are mounted on a single flexible board, the distance G1 and the distance G2 can be relatively easily made identical to each other.

The position of the magnet 48 and the connecting structure of the magnet 48 to the pin-gripping part 165 may be appropriately changed, as long as the magnet 48 is movable integrally with the pin-gripping part 165 in the front-rear direction relative to the anvil 161. Thus, the magnet 48 may be fixed to the pin-gripping part 165 or to any member that is directly or indirectly coupled to the pin-gripping part 165 to be integrally movable with the pin-gripping part 165.

Other possible modifications are now described.

The fastening tool 1 may be configured to fasten the workpieces W via a fastener of a different type (for example, a blind rivet, and a non-tear-off type fastener of the multi-piece swage type fastener) that is different from the fastener 9 exemplarily described in the above embodiment. The fastening tool 1 may be configured such that the anvil 161 and the pin-gripping part 165 are replaceable, so that multiple types of fasteners can be selectively used with the fastening tool 1. The shapes of the tool body 10, the nose 16 and the handle 17 and the components and the connecting structure thereof may be changed as needed.

The motor 21 may be a motor other than the brushless DC motor (for example, a brushed motor or an AC motor). The fastening tool 1 may be driven by electric power supplied from an external AC power source, instead of the battery 145.

The components and arrangement of the driving mechanism 3 may be changed as needed, as long as the driving mechanism 3 is driven by the power of the motor 21 and the pin-gripping part 165 is movable in the front-rear direction relative to the anvil 161. For example, instead of the ball-screw mechanism 40, a feed-screw mechanism, which includes a nut and a screw shaft directly engaged with the nut, may be employed in the driving mechanism 3. Further, the ball-screw mechanism 40 may be configured such that the screw shaft 45 is rotatably supported to be substantially immovable in the front-rear direction and the nut 41 is movable in the front-rear direction in response to rotation of the nut 45. In such a modification, the pin-gripping part 165 may be directly or indirectly connected to the nut 41. The power may be transmitted from the motor 21 to the ball-screw mechanism 40 using a gear train other than that described in the above embodiment.

The control circuit of the control device 20 may be an ASIC (Application Specific Integrated Circuits) or a programmable logic device such as a FPGA (Field Programmable Gate Array), instead of the microcomputer.

Further, in view of the nature of the present disclosure, the above-described embodiment and the modifications thereto, the following Aspects are provided. At least one of the following Aspects can be employed in combination with at least one of the above-described embodiment, the above-described modifications and the features recited in the claims.

(Aspect 1)

Each of the first magnetic sensor and the second magnetic sensor is configured to detect a component of the magnetic field in a direction perpendicular to the sensing surface.

(Aspect 2)

Each of the first magnetic sensor and the second magnetic sensor is a Hall sensor that is configured to detect the magnetic field of the magnet based on the principle of Hall effect.

(Aspect 3)

The control device is configured to control movement of the pin-gripping part by controlling driving of the motor.

(Aspect 4)

A first one of the first sensing surface and the second sensing surface faces the second axis, and a second one of the first sensing surface and the second sensing surface faces away from the second axis.

(Aspect 5)

A first one of the first sensing direction and the second sensing direction is oriented away from the second axis, and a second one of the first sensing direction and the second sensing direction is oriented toward the second axis.

DESCRIPTION OF THE REFERENCE NUMERALS

1: fastening tool, 10: tool body, 102: metal housing, 103: barrel part, 104: support part, 105: screw hole, 107: plastic housing, 108: opening, 109: eyebolt, 12: housing part, 121: guide plate, 123: guide groove, 125: support rib, 13: extending part, 14: battery holding part, 141: battery holder, 145: battery, 15: container, 16: nose, 161: anvil, 162: coupling member, 163: coupling member, 165: pin-gripping part, 166: coupling member, 17: handle, 171: trigger, 172: switch, 18: auxiliary handle, 20: control device, 21: motor, 213: motor shaft, 25: LED light, 3: driving mechanism, 31: planetary-gear speed reducer, 32: driving gear, 33: idle gear, 40: ball-screw mechanism, 41: nut, 411: driven gear, 45: screw shaft, 450: driving shaft, 451: extension shaft, 46: bearing holder, 461: base, 462: screw hole, 463: arm, 465: bearing, 47: magnet holder, 471: through hole, 475: screw, 48: magnet, 8: position detection mechanism, 80: magnetic sensor, 81: first sensor, 82: second sensor, 86: first board, 87: second board, 9: fastener, 91: pin, 95: collar, 911: shaft, 913: small-diameter portion, 915: head, A1: driving axis, A2: rotational axis, A3: movement axis, P: plane, MS (MS1, MS2): mounting surface, SD (SD1, SD2): sensing direction, SP (SP1, SP2): sensing point, SS (SS1, SS2): sensing surface, W: workpiece.

What is claimed is:

1. A fastening tool configured to fasten workpieces via a fastener including a pin and a tubular part, the fastening tool comprising: a motor; an anvil configured to abut the tubular part; a pin-gripping part configured to grip the pin and to be moved relative to the anvil along a first axis, using power of the motor, the first axis defining a front-rear direction of the fastening tool; a magnet having a north pole and a south pole aligned in the front-rear direction, the magnet being configured to move integrally with the pin-gripping part in the front-rear direction along a second axis parallel to the first axis; a first magnetic sensor having a first sensing surface; a second magnetic sensor having a second sensing surface and disposed rearward of the first magnetic sensor; and a control device configured to (i) move the pin-gripping part rearward relative to the anvil from an initial position to a stop position based on a detection result of the second magnetic sensor and (ii) to move the pin-gripping part forward relative to the anvil from the stop position to the initial position based on a detection result of the first magnetic sensor, wherein: the first magnetic sensor and the second magnetic sensor are unipolar detection type sensors configured to detect a same specified pole of the magnet, and the first magnetic sensor and the second magnetic sensor are arranged such that an orientation of the first sensing surface relative to the second axis is opposite to an orientation of the second sensing surface relative to the second axis.

2. The fastening tool as defined in claim 1, wherein:

the specified pole is a first one of the north pole and the south pole that is rearward of a second one of the north pole and the south pole, the first sensing surface faces the second axis, and the second sensing surface faces away from the second axis.

3. The fastening tool as defined in claim 2, wherein the specified pole is the north pole.

4. The fastening tool as defined in claim 1, wherein the first magnetic sensor and the second magnetic sensor are at the same side of an imaginary plane containing the second axis.

5. The fastening tool as defined in claim 1, wherein a distance between the magnet and a sensing point of the first magnetic sensor when the magnet and the first magnetic sensor are on a first straight line that is perpendicular to the second axis is equal to a distance between the magnet and a sensing point of the second magnetic sensor when the magnet and the second magnetic sensor are on a second straight line that is perpendicular to the second axis.

6. The fastening tool as defined in claim 1, wherein the first magnetic sensor and the second magnetic sensor are respectively mounted on a first board and a second board that are separate components.

7. The fastening tool as defined in claim 1, wherein the first magnetic sensor and the second magnetic sensor are sensors having an identical structure.

8. The fastening tool as defined in claim 1, wherein:

the fastening tool is configured to be used with the fastener of a tear-off type in which the pin having a small-diameter portion to be broken is inserted into the tubular part, and the pin-gripping part is configured to fasten the workpieces via the fastener and to break the pin at the small-diameter portion by pulling the pin rearward relative to the tubular part while the pin-gripping part moves from the initial position to the stop position.

9. A fastening tool configured to fasten workpieces via a fastener including a pin and a tubular part, the fastening tool comprising: a motor; an anvil configured to abut the tubular part; a pin-gripping part configured to grip the pin and to be moved relative to the anvil along a first axis, using power of the motor, the first axis defining a front-rear direction of the fastening tool; a magnet having a north pole and a south pole aligned in the front-rear direction, the magnet being configured to move integrally with the pin-gripping part in the front-rear direction along a second axis parallel to the first axis; a first magnetic sensor having a first sensing direction defined therefor, a second magnetic sensor having a second sensing direction defined therefor, the second magnetic sensor being disposed rearward of the first magnetic sensor; and a control device configured (i) to move the pin-gripping part rearward relative to the anvil from an initial position to a stop position based on a detection result of the second magnetic sensor and (ii) to move the pin-gripping part forward relative to the anvil from the stop position to the initial position based on a detection result of the first magnetic sensor, wherein: the first magnetic sensor and the second magnetic sensor are unipolar detection type sensors configured to detect a same specified pole of the magnet, and the first magnetic sensor and the second magnetic sensor are arranged such that an orientation of the first sensing direction relative to the second axis is opposite to an orientation of the second sensing direction relative to the second axis.

10. The fastening tool as defined in claim 9, wherein:

the specified pole is a first one of the north pole and the south pole that is rearward of a second one of the north pole and the south pole, the first sensing direction is away from the second axis, and the second sensing direction is toward the second axis.

11. The fastening tool as defined in claim 10, wherein the specified pole is the north pole.

12. The fastening tool as defined in claim 9, wherein the first magnetic sensor and the second magnetic sensor are at the same side of an imaginary plane containing the second axis.

13. The fastening tool as defined in claim 9, wherein a distance between the magnet and a sensing point of the first magnetic sensor when the magnet and the first magnetic sensor are on a first straight line that is perpendicular to the second axis is equal to a distance between the magnet and a sensing point of the second magnetic sensor when the magnet and the second magnetic sensor are on a second straight line that is perpendicular to the second axis.

14. The fastening tool as defined in claim 9, wherein the first magnetic sensor and the second magnetic sensor are respectively mounted on a first board and a second board that are separate components.

15. The fastening tool as defined in claim 9, wherein the first magnetic sensor and the second magnetic sensor are sensors having an identical structure.

16. The fastening tool as defined in claim 9, wherein:

the fastening tool is configured to be used with the fastener of a tear-off type in which the pin having a small-diameter portion to be broken is inserted into the tubular part, and the pin-gripping part is configured to fasten the workpieces via the fastener and to break the pin at the small-diameter portion by pulling the pin rearward relative to the tubular part while the pin-gripping part moves from the initial position to the stop position.

* * * * *